US005566946A

United States Patent [19]

Parker

[11] Patent Number: 5,566,946

[45] Date of Patent: Oct. 22, 1996

[54] METHOD OF PLAYING A CARD GAME

[76] Inventor: Alan G. Parker, Y-Fron, Peterston-Super-Ely, South Glamorgan, CF5 6LZ, United Kingdom

[21] Appl. No.: 543,940

[22] Filed: Oct. 17, 1995

[51] Int. Cl.[6] ..... A63F 1/00

[52] U.S. Cl. ..... 273/292; 273/274

[58] Field of Search ..... 273/292, 274, 273/309

[56] References Cited

U.S. PATENT DOCUMENTS

| | | | |
|---|---|---|---|
| 4,861,041 | 8/1989 | Jones et al. | 273/292 |
| 5,098,107 | 3/1992 | Boylan et al. | 273/292 |
| 5,174,579 | 12/1992 | Griffiths | 273/292 |
| 5,275,415 | 1/1994 | Wisted | 273/274 |
| 5,390,934 | 2/1995 | Grassa | 273/292 |
| 5,454,570 | 10/1995 | Karal | 273/292 |

OTHER PUBLICATIONS

Pontoon, "Scarne's Encyclopedia Of Games" by John Scarne, p. 286, Harper & Row Publishers Dec. 1973.

Over/Under 13 Blackjack, Gaming Concepts, Inc. Dec. 1988.

*Primary Examiner*—Benjamin H. Layno

*Attorney, Agent, or Firm*—Young & Thompson

[57] ABSTRACT

A Blackjack type game is played with one or more conventional 52 card packs, with a dealer and one or more players, and with scoring according to the usual Blackjack conventions. But players have two kinds of bets, an Ante to place before play commences, and a Play bet to place after the first deal. The Ante bet remains fixed, but the Play bet may be increased during the course of play. All bets are forfeit to the dealer if a player loses, but if he wins different odds may be payable on the Ante and Play bets.

10 Claims, 1 Drawing Sheet

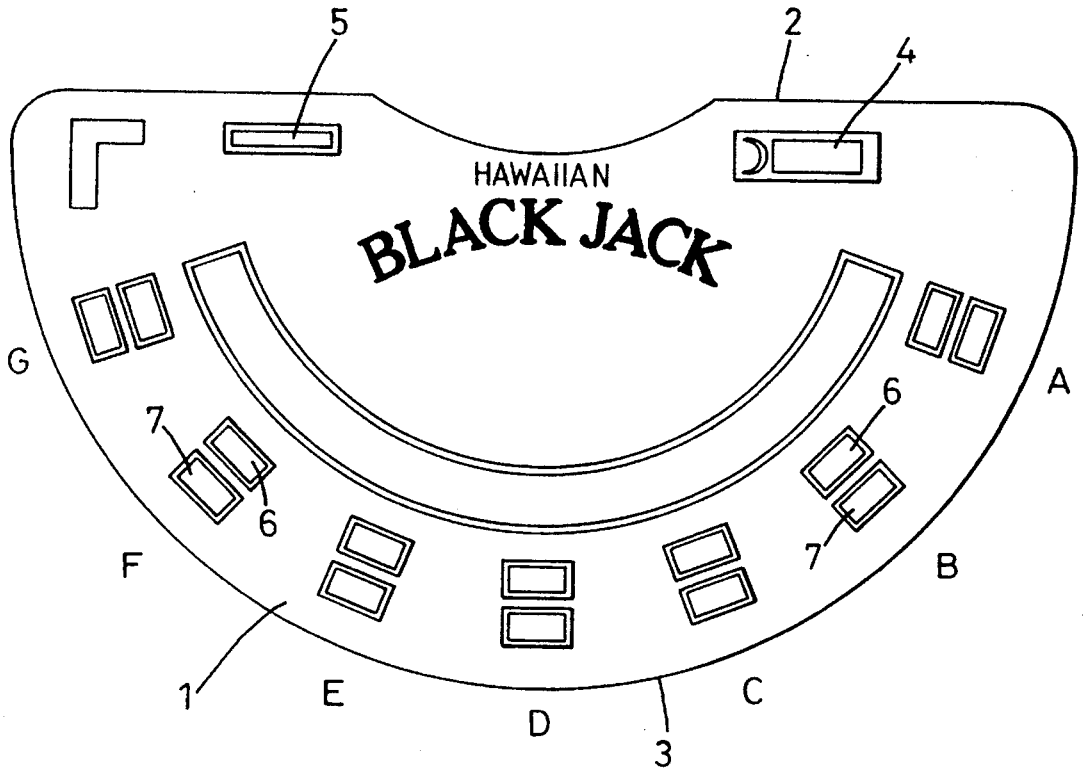
5
2
4
HAWAIIAN
BLACK JACK
G
A
7
6
6
7
F
B
1
E
D
C
3

METHOD OF PLAYING A CARD GAME

This invention relates to card games and concerns a variation of the known game of Blackjack. It will be assumed that the basic elements of Blackjack are known, and certain terms commonly used in playing that game will appear in this specification. For example, when a player "stands", it means that he retains his hand of cards as it is, while if he "busts" he has drawn a card that brings the total value of the cards in his hand to over 21. To "fold" means to throw in one's hand and to forfeit any bets, while to "draw" means to take a card from the so far undealt pack.

The values assigned to the cards will also be the conventional ones of Blackjack. Thus, an Ace may count 1 or 11, while the Court cards will all be valued at 10.

The main difference between the proposed game and the known one is in the method of betting.

According to the present invention there is provided a method of playing a Blackjack type game using at least one standard pack of 52 playing cards and with a dealer and at least one player, the method comprising the steps of:

(i) Each player placing an Ante bet, (ii) The dealer dealing each player two cards and himself one or two cards, (iii) Each player electing in turn whether to fold or play, the player folding forfeiting his Ante bet to the dealer and the player playing placing a Play bet separately from his Ante bet.

(iv) Each player so playing further electing either to stand or to draw with the option of standing after each draw but going bust if the total value of his cards, according to conventional Blackjack rules, exceeds 21, in which case both Ante and Play bets are forfeit to the dealer, and (v) The dealer, provided there is at least one player standing, dealing further cards to himself to a stand or bust state, and (a) if the dealer's hand is bust, a multiple of each standing player's Ante bet being returned to that player, and the player recovering his Play bet, (b) if the dealer's stood hand exceeds any of the standing players' hands, all bets of those players being forfeit to the dealer, (c) if any standing player's hand exceeds the dealer's stood hand, that player being paid by the dealer a multiple of his Ante bet and a multiple of his Play bet, and (d) if the dealer's and player's hands are equal, there being a stand-off with each player with an equal hand having his bets returned.

Preferably, the dealer will have to draw cards to a total minimum value, typically 17.

The Play bet may be limited to a fixed multiple of the Ante bet, and preferably it will be confined to being equal to the Ante. With certain card combinations, for example a Blackjack or a Royal Blackjack, it will usually be forbidden for the player to place a Play bet, but if he wins (as he is likely to) there will be a better return than the norm on the Ante bet.

Generally, there will be even money paid on the Ante bets. In other words, the player will receive back his original stake plus the same again if he wins.

However, if the player has certain card combinations (not necessarily just the Blackjack hands referred to above) while winning, the dealer may be obliged to pay the player certain higher multiples of that player's Ante bet.

When the player wins, the multiple of his Play bet may be fixed, but preferably it will be greater the larger the excess. The multiple of a winning Play bet may also be higher for certain combinations of cards than for others with the same total. In particular, three sevens would be rewarded.

It will normally be permitted for players to increase their Play bets before a first draw, although this will generally be limited. For example, the only increase permitted may be by doubling down the existing bet. Also, having doubled down, only one card may be drawn.

If a player receives two cards of equal value, he may split and draw cards to make and play two separate hands. The Ante bet must then be duplicated. After drawing, the player places Play bets and he can double the Play bet on either or both hands before drawing again. When splitting on certain good cards, in particular Aces, the player may be restricted to drawing just one card on each hand.

For a better understanding of the invention, one embodiment will now be described, by way of example, with reference to the accompanying drawing in which the single figure is a plan view of a table for playing a modified form of Blackjack.

The table 1 is of conventional semi-circular form with a dealer at the central indent of the generally straight side 2 and players at positions A, B, C, etc., around the curved side 3. The dealer is equipped with the usual shoe 4 from which cards are dealt, and a tray 5 for the tokens with which bets are placed. Each player position is marked with two zones 6, 7, one for Ante bets and the other for Play bets. It will be preferred that the shoe should have a large capacity for the game to be played with six or even eight packs mixed together.

To start a game, each player places an Ante bet on the appropriate zone 6. There may be minimum and maximum limits for this.

The dealer then deals each player two cards. These may be face down, face up, or one face down and one up. He deals himself one card, and that will preferably be face up. But there may be variations where it is face down, or where he deals himself two cards, one face down and the other face up.

Each player then assesses his own pair of cards and decides in the light of what the dealer shows how to continue. With a poor hand, say totalling 15 and the dealer having a good card, and ace for example, he may decide not to risk anything further, and simply fold. That forfeits his Ante bet to the dealer.

With a Blackjack in his hand, a player simply stands. Otherwise, if he decides to play, he must place a bet on the Play zone 7. There may be upper and lower limits imposed, and in one form of the game it must be equal to the Ante bet. With a good hand, he may then stand, while if it has potential, he may draw. He may increase his Play bet prior to this first draw, and this may be restricted to doubling it. Having doubled down and drawn, he must stand (if not bust). But if the initial Play bet is not increased he may draw as many times as he likes. Increasing the Play bet before later draws will not be permitted. This continues until either the player stands or goes bust. Should the player go bust, then both the Ante and Play bets are taken by the dealer.

Each player around the table performs similar operations. Finally, the dealer plays his hand. If low scoring initially, he will have to draw until the value is 17 or more, and if he goes bust, each player still in the game wins even money on his Ante bet while keeping his Play bet. If the dealer achieves a better hand than any of the remaining players, he collects all the bets laid by those players. If the dealer and a player have hands of equal value, that is a stand-off and the player simply recovers his bets.

If a player has a better hand than the dealer, then the player receives even money on his Ante bet and winnings on his Play bet. These may be scaled according to the amount by which his hand exceeds the value of the dealer's hand. Since the dealer must reach 17, there are four possible points differences, and one differential scale could be that for a win by one point it would be even money, for a win by two points a 2:1 payout, by three points 3:1 and by four points 4:1.

Certain special combinations of cards may also generate special payouts. For example, a Blackjack (which is an Ace with a ten or a Court card) in the player's hand could generate a 3:1 payout on his Ante bet. A Royal Blackjack (which is an Ace and King of the same suit) could pay 6:1. It will be remembered that with such hands, the player must stand without placing a Play bet. Three sevens are also "special" and could result in a 20:1 payout on the Play bet, with even money on the Ante bet.

As mentioned above, if a player has two equal value cards, he can split the hand and play both according to the above rules.

The game may also include the customary insurance feature of Blackjack whereby players can insure against a loss if the dealer shows an ace.

There may also be a separate progressive jackpot whereby players wager game by game on certain hand or hands occurring, the stakes building until a winning hand appears.

The present invention is also readily adaptable to electronic gaming devices, as have other known Blackjack type games been adapted.

The payout and ranking of hands in the preferred form can be summarised as follows:

| | Return on Player's Stake | |
|---|---|---|
| | "Ante" | "Play" |
| Dealer reaches total over 21 | Even Money | Returned to Player |
| Player reaches total higher than dealer | | |
| By 1 point | Even Money | Even Money |
| By 2 points | Even Money | 2/1 |
| By 3 points | Even Money | 3/1 |
| By 4 points | Even Money | 4/1 |
| Blackjack (Ace, and 10 or picture) | 3/1 | Not applicable |
| Royal Blackjack (Ace and King of same suit) | 6/1 | Not applicable |
| 3 Sevens | Even Money | 20/1 |
| Ranking of Hands | | |
| 3 Sevens | | |
| Royal Blackjack (Ace and King of same suit) | | |
| Blackjack | | |
| 21 Points | | |
| 20 Points | | |
| 19 Points | | |
| 18 Points | | |
| 17 Points | | |

I claim:

1. A method of playing a Blackjack type game using at least one standard pack of 52 playing cards and with a dealer and at least one player, the method comprising the steps of:

(i) Each player placing an Ante bet, (ii) The dealer dealing each player two cards and himself one or two cards, (iii) Each player electing in turn whether to fold or play, the player folding forfeiting his Ante bet to the dealer and the player playing placing a Play bet separately from his Ante bet, (iv) Each player so playing further electing either to stand or to draw with the option of standing after each draw but going bust if the total value of his cards, according to conventional Blackjack rules, exceeds 21, in which case both Ante and Play bets are forfeit to the dealer, and (v) The dealer, provided there is at least one player standing, dealing further cards to himself to a stand or bust state, and (a) if the dealer's hand is bust, a multiple of each standing player's Ante bet being returned to that player, and the player recovering his Play bet, (b) if the dealer's stood hand exceeds any of the standing players' hands, all bets of those players being forfeit to the dealer, (c) if any standing player's hand exceeds the dealer's stood hand, that player being paid by the dealer a multiple of his Ante bet and a multiple of his Play bet, and (d) if the dealer's and player's hands are equal, there being a stand-off with each player with an equal hand having his bets returned.

2. A method of play according to claim 1, wherein the dealer has to draw cards to a total minimum value.

3. A method of play according to claim 2, wherein the minimum value is 17.

4. A method of play according to claim 1, wherein the Play bet is limited to a fixed multiple of the Ante bet.

5. A method of play according to claim 1, wherein even money is paid on winning Ante bets.

6. A method of play according to claim 5, with the modification that certain higher multiples of a winning Ante bet are paid when the win is achieved by certain card combinations.

7. A method of play according to claim 6, wherein the certain combinations include a Blackjack and a Royal Blackjack.

8. A method of play according to claim 1, wherein the multiple of a winning Play bet is greater the larger the excess of the winning players' hand over that of the dealer.

9. A method of play according to claim 1, wherein the multiple of a winning Play bet is higher for certain combinations of cards than for others with the same total.

10. A method of play according to claim 1, wherein a player receiving cards of equal value can split and draw cards to make and play two separate hands, duplicating the Ante and initial Play bets.

* * * * *